US008319686B2

(12) United States Patent
Park et al.

(10) Patent No.: US 8,319,686 B2
(45) Date of Patent: Nov. 27, 2012

(54) APPARATUS AND METHOD FOR CONTROLLING RADIATION DIRECTION

(75) Inventors: Juderk Park, Daejeon (KR); Sang-Joon Park, Daejeon (KR); Cheol-Sig Pyo, Daejeon (KR); Jong-suk Chae, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 232 days.

(21) Appl. No.: 12/747,506

(22) PCT Filed: Nov. 17, 2008

(86) PCT No.: PCT/KR2008/006737

§ 371 (c)(1), (2), (4) Date: Jun. 10, 2010

(87) PCT Pub. No.: WO2009/075480

PCT Pub. Date: Jun. 18, 2009

(65) Prior Publication Data

US 2010/0277370 A1 Nov. 4, 2010

(30) Foreign Application Priority Data

Dec. 11, 2007 (KR) ..... 10-2007-0128225

(51) Int. Cl.
*H01Q 3/00* (2006.01)
*H01Q 19/00* (2006.01)
*H01Q 19/10* (2006.01)

(52) U.S. Cl. ..... 342/359; 343/833; 343/834

(58) Field of Classification Search ..... 342/367, 342/368–377, 359; 343/833, 834, 846, 745, 343/750

See application file for complete search history.

(56) References Cited

U.S. PATENT DOCUMENTS

| | | | | |
|---|---|---|---|---|
| 5,235,343 | A * | 8/1993 | Audren et al. | 343/816 |
| 6,407,719 | B1 * | 6/2002 | Ohira et al. | 343/893 |
| 6,600,456 | B2 * | 7/2003 | Gothard et al. | 343/834 |
| 6,753,826 | B2 * | 6/2004 | Chiang et al. | 343/834 |
| 6,765,536 | B2 * | 7/2004 | Phillips et al. | 343/702 |
| 6,888,504 | B2 * | 5/2005 | Chiang et al. | 343/702 |
| 6,972,729 | B2 * | 12/2005 | Wang | 343/833 |

(Continued)

FOREIGN PATENT DOCUMENTS

JP 2002-261532 A 9/2002

(Continued)

OTHER PUBLICATIONS

International Search Report for PCT/KR2008/006737 filed Nov. 17, 2008.

(Continued)

*Primary Examiner* — Jack W Keith
*Assistant Examiner* — Cassie Galt

(57) ABSTRACT

Provided are an apparatus and method for controlling a radiation direction. The apparatus includes parasitic elements disposed in proximity to the antenna, wherein each of the parasitic elements comprises an antenna; a first portion that is inclined with respect to a prepared ground surface at a first angle and a second portion that is inclined with respect to the first portion at a second angle; a lumped element having a variable reactance, which is disposed on each of the first and second portions; and a determination unit controlling the reactance of the lumped element so as to determine the radiation direction of the antenna. By using the apparatus and the method, the antenna has various radiation directions.

11 Claims, 3 Drawing Sheets

U.S. PATENT DOCUMENTS

| | | | | |
|---|---|---|---|---|
| 6,989,721 | B2 | 1/2006 | Toda et al. | |
| 7,057,573 | B2 | 6/2006 | Ohira | |
| 7,106,270 | B2 * | 9/2006 | Iigusa et al. | 343/833 |
| 7,129,897 | B2 | 10/2006 | Iigusa et al. | |
| 7,391,386 | B2 | 6/2008 | Sawaya et al. | |
| 7,675,469 | B2 * | 3/2010 | Ohba et al. | 343/702 |
| 7,830,320 | B2 * | 11/2010 | Shamblin et al. | 343/747 |
| 2002/0105471 | A1 | 8/2002 | Kojima et al. | |
| 2003/0137451 | A1 | 7/2003 | Cheng et al. | |

FOREIGN PATENT DOCUMENTS

| | | | |
|---|---|---|---|
| JP | 2003-304112 | A | 10/2003 |

OTHER PUBLICATIONS

Written Opinion of the International Searching Authority for PCT/KR2008/006737 filed Nov. 17, 2008.

* cited by examiner

APPARATUS AND METHOD FOR CONTROLLING RADIATION DIRECTION

TECHNICAL FIELD

The present invention relates to an antenna, and more particularly, to a method and apparatus for controlling a radiation direction of an antenna to have a predetermined orientation.

BACKGROUND ART

In electrically steerable parasitic array radiator (ESPAR) antenna systems, the radiation direction of an antenna can be controlled. In this regard, the radiation direction of an antenna refers to a direction in which the antenna transmits or receives electromagnetic waves.

An ESPAR antenna system includes a monopole antenna and parasitic elements which are vertically mounted in proximity to the monopole antenna on a prepared ground surface. Each of the parasitic elements includes a lumped element having a variable reactance, and the radiation direction of the monopole antenna is controlled by adjusting the reactance of each lumped element. Since parasitic elements of the ESPAR antenna system are vertically mounted on the ground surface and lumped elements are included in such parasitic elements, only the radiation direction of the monopole antenna in the ESPAR antenna system parallel to the ground surface on which the monopole antenna is mounted can be changed, and a radiation direction perpendicular to the ground surface cannot be changed.

Thus, ESPAR antenna systems have a limitation in terms of controlling the radiation direction of an antenna.

DISCLOSURE OF INVENTION

Technical Problem

The present invention provides an apparatus for controlling a radiation direction of an antenna to obtain various radiation directions.

The present invention also provides a method of controlling a radiation direction of an antenna to obtain various radiation directions.

The present invention also provides a computer-readable recording medium for storing a computer program that is used to control an antenna to have various radiation directions.

Technical Solution

According to an aspect of the present invention, there is provided an apparatus for controlling the radiation direction of an antenna, the apparatus including: an antenna; parasitic elements disposed in proximity to the antenna, wherein each of the parasitic element comprises a first portion that is inclined with respect to a ground surface at a first angle and a second portion that is inclined with respect to the first portion at a second angle; a lumped element having a variable reactance, disposed on each of the first and second portions; and a determination unit controlling the reactance of the lumped element to determine the radiation direction of the antenna.

According to another aspect of the present invention, there is provided a method of controlling a radiation direction of an antenna in proximity to parasitic elements, each of which comprises lumped elements having a variable reactance, the method including: controlling a reactance of the lumped element disposed on a first portion that is inclined with respect to a ground surface at a first angle in consideration of a predetermined radiation direction; and controlling a reactance of the lumped element disposed on a second portion that is inclined with respect to the first portion at a second angle in consideration of the predetermined radiation direction.

According to another aspect of the present invention, there is provided a computer-readable recording medium storing a computer program that is used to perform the method of controlling a radiation direction of an antenna in proximity to parasitic elements, each of which comprises lumped elements having a variable reactance, wherein the method includes: controlling a reactance of the lumped element disposed on a first portion that is inclined with respect to a ground surface at a first angle in consideration of a predetermined radiation direction; and controlling a reactance of the lumped element disposed on a second portion that is inclined with respect to the first portion at a second angle in consideration of the predetermined radiation direction.

Advantageous Effects

According to a method and apparatus for controlling a radiation direction of an antenna, each of parasitic elements includes a first portion that is inclined with respect to a ground surface connected to the parasitic element at a first angle and a second portion that is inclined with respect to the first portion at a second angle, and a lumped element is disposed on each of the first and second portions. Therefore, the antenna can have various radiation directions. For example, the radiation direction of the antenna can be not only parallel to the ground surface connected to the antenna and but also perpendicular to the ground surface.

DESCRIPTION OF DRAWINGS

The above and other features and advantages of the present invention will become more apparent by describing in detail exemplary embodiments thereof with reference to the attached drawings in which.

BEST MODE

The present invention will now be described more fully with reference to the accompanying drawings, in which exemplary embodiments of the invention are shown.

Figure 1A:
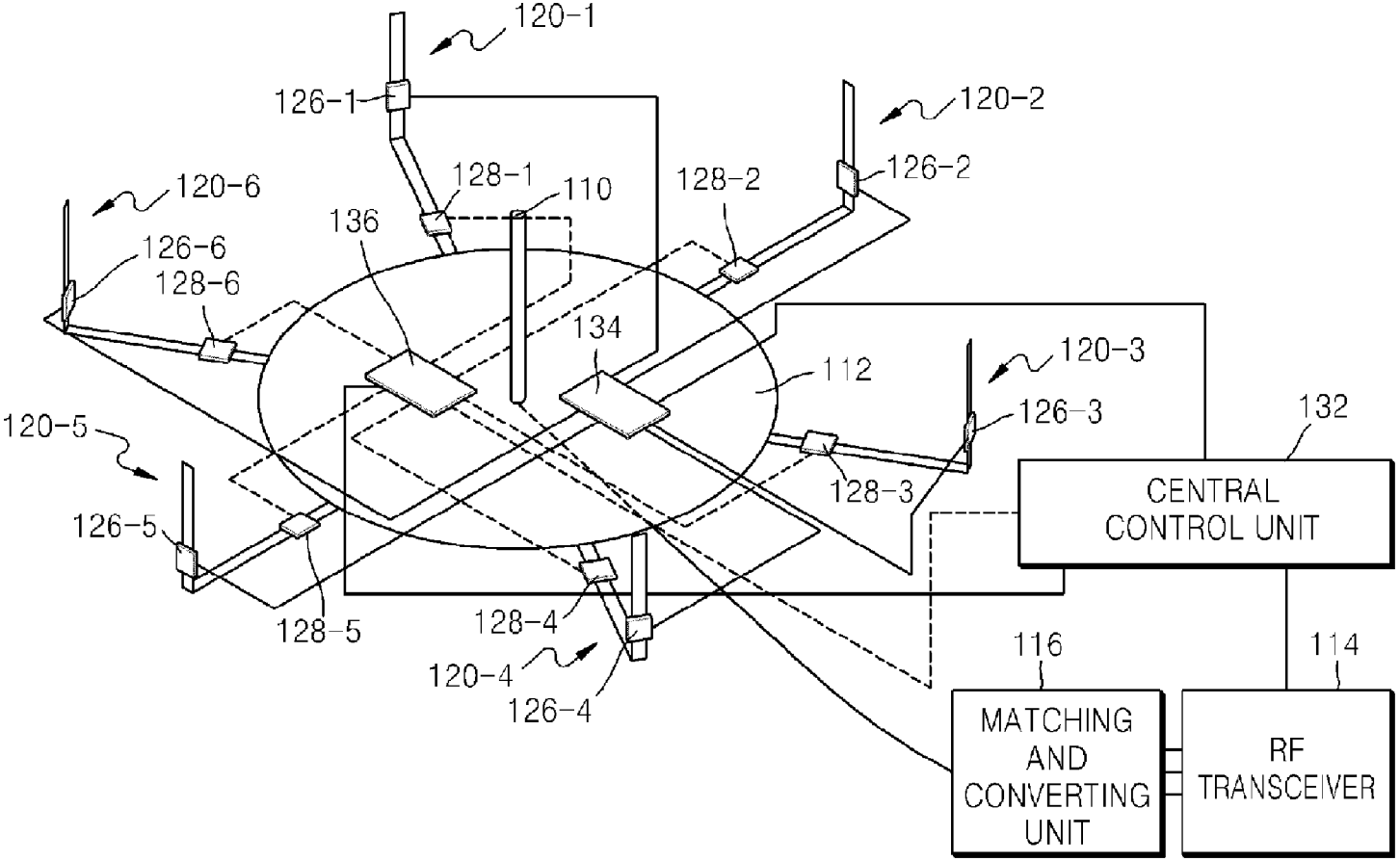
FIG. 1A is a block diagram illustrating an apparatus for controlling a radiation direction of an antenna according to an embodiment of the present invention.
Figure 1B:
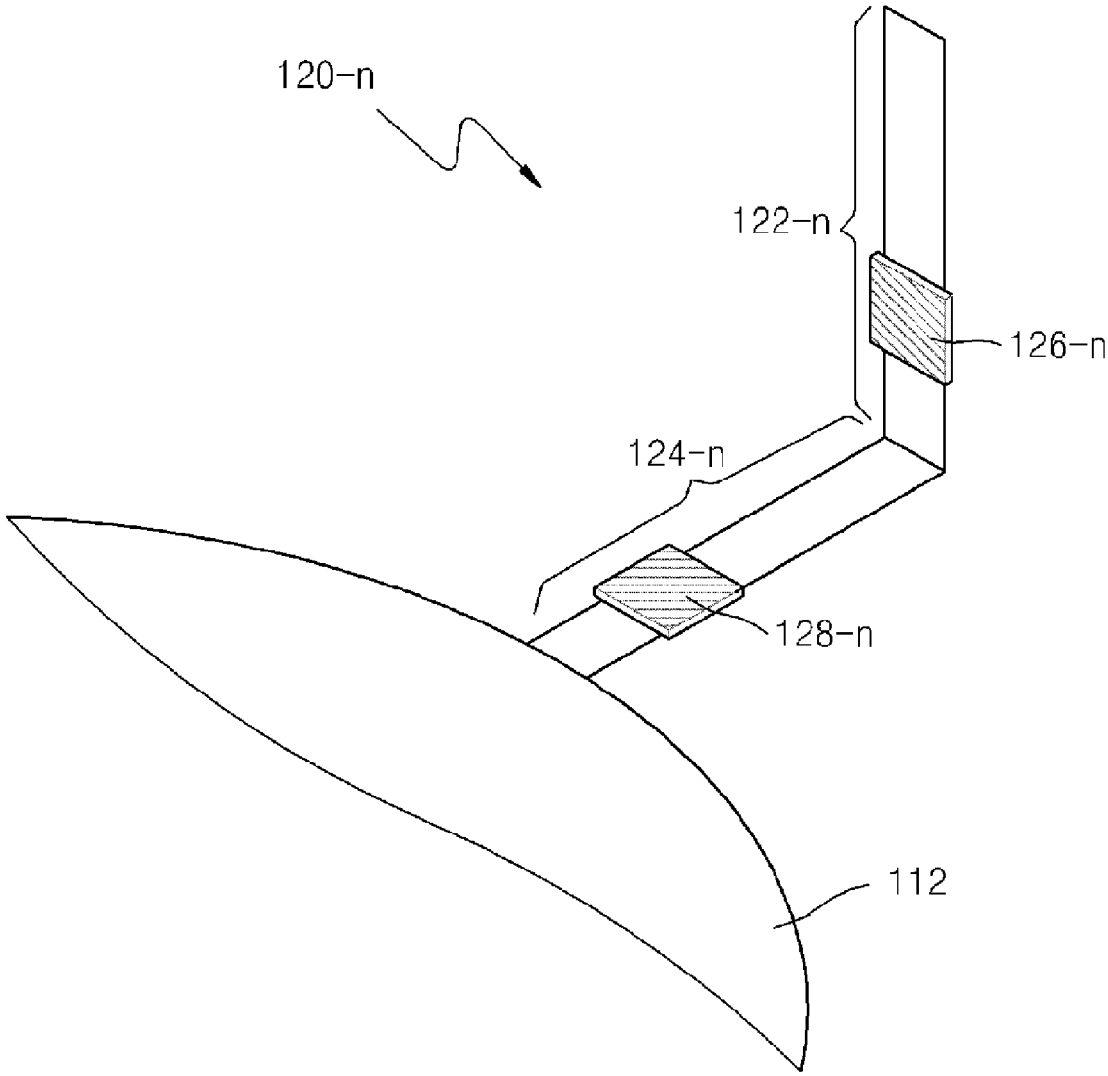
FIG. 1B is a reference diagram for explaining a parasitic element used in the present invention.

FIG. 1A is a block diagram illustrating an apparatus for controlling a radiation direction of an antenna according to an embodiment of the present invention, and FIG. 1B is a reference diagram for explaining a parasitic element used in the present invention.

Referring to FIG. 1A, the apparatus for controlling the radiation direction of an antenna according to an embodiment of the present invention includes an antenna 110, a ground surface 112, a radio frequency (RF) tranceiver 114, a matching and converting unit 116, parasitic elements 120-1, 120-2, through to 120-N, lumped elements 126-1, 126-2, through to 126-N, 128-1, 128-2, through to 128-N, and a determination unit. In this regard, N denotes a natural number of 2 or more. However, in the current embodiment, N is 6.

The antenna 110 converts electrical signals into electromagnetic waves and receives the converted electromagnetic waves, or converts electromagnetic waves into electrical signals and transmits the converted electrical signals. The ground surface 112 functions as a ground and is a conductor. In the present specification, the ground surface 112 refers to a prepared ground surface. The antenna 110 can be, but is not limited to, a monopole antenna. According to the current embodiment, the antenna 110 is a monopole antenna and connected to the ground surface 112.

The RF tranceiver 114 can receive and transmit electrical signals. When the RF tranceiver 114 transmits electrical signals, the antenna 110 converts the electrical signals into magnetic waves and transmits the converted magnetic waves. On the other hand, when the RF tranceiver 114 receives electrical signals, the antenna 110 converts magnetic waves into electrical signals and receives the converted electrical signals.

The matching and converting unit 116 acts as a passage of impedance of the antenna 110 and the electrical signals which are input into or output from the antenna 110. In addition, the matching and converting unit 116 matches impedances of electric wires connected to the antenna 110 with each other.

Meanwhile, when the antenna 110 is a balanced circuit, electrical signals input to or output from the antenna 110 should be appropriately converted because an electric wire, such as a coaxial cable, connected to the antenna 110 is an unbalanced circuit. For example, electrical signals input to the antenna 110 through the electric wire may be appropriately converted to match the antenna 110 with the electric wire, and electrical signals that are output from the antenna 110 and travel through the electric wire may be appropriately converted to match the antenna 110 with the electric wire and are then transmitted to the RF tranceiver 114. Such a conversion is performed by the matching and converting unit 116. In this regard, the balanced circuit refers to a circuit in which both terminals in a pair are not grounded and the unbalanced circuit refers to a circuit in which only one of the terminals in a pair is grounded.

The parasitic elements 120-1, 120-2, through to 120-6 are connected to the ground surface 112.

The parasitic elements 120-1, 120-2, through to 120-6 are in proximity to the antenna 110. Specifically, the parasitic elements 120-1, 120-2, through to 120-6 are spaced apart by a predetermined distance from the antenna 110.

Each of the parasitic elements 120-1, 120-2, through to 120-6 includes a first portion that is inclined with respect to the ground surface 112 and a second portion that is inclined with respect to the first portion. For example, each of the parasitic elements 120-1, 120-2, through to and 120-6 includes a first portion that is inclined with respect to the ground surface 112 at a first predetermined angle and a second portion that is inclined with respect to the first portion by a second predetermined angle. According to the current embodiment, as illustrated in FIGS. 1A and 1B, each of the parasitic elements 120-1, 120-2, through to 120-6 has a portion **122-*n* perpendicular to the ground surface 112 and a portion 124-*n* parallel to the ground surface 112. In this regard, n is an integral satisfying $1 \leqq n \leqq N$. That is, in the current embodiment, the parasitic element 120-*n*** is L shaped.

As illustrated in FIG. 1B, a lumped element **126-*n* is disposed on the portion 122-*n* of the parasitic element 120-*n* which is perpendicular to the ground surface 112, and a lumped element 128-*n* is disposed on the portion 124-*n* of parasitic element 120-*n* which is parallel to the ground surface 112. As described above, the lumped element 126-*n* or the lumped element 128-*n* refers to an element having a variable reactance. Specifically, the lumped element 126-*n* or the lumped element 128-*n*** refers to an element of which at least one of capacitance and inductance vary.

When reactance of the lumped element **126-*n* disposed on the portion 122-*n* perpendicular to the ground surface 112 is changed, the radiation direction of the antenna 110 is changed within a directional plane parallel to the ground surface 112**.

Likewise, when reactance of the ground surface 112 disposed on the portion **124-*n* parallel to the ground surface 112 is changed, the radiation direction of the antenna 110 is changed within a directional plane perpendicular to the ground surface 112**.

A determination unit controls the reactance of each of the lumped elements 126-1, 126-2, through to 126-N, 128-1, 128-2, through to 128-N and determines the radiation direction of the antenna 110.

Referring to FIG. 1A, the determination unit may include a central control unit 132, a parallel radiation direction control unit 134, and a perpendicular radiation direction control unit 136.

The central control unit 130 controls the parallel radiation direction control unit 134 and the perpendicular radiation direction control unit 136 so that the antenna 110 has a specific radiation direction. In this regard, the specific radiation direction may be determined in advance.

When the radiation direction of the antenna 110 is predetermined, the parallel radiation direction control unit 134 applies a bias voltage corresponding to the predetermined radiation direction to each of the lumped elements 126-1, 126-2, through to 126-6 in order to adjust the reactance of each of the lumped elements 126-1, 126-2, through to 126-6 corresponding to the determined radiation direction.

Also, the perpendicular radiation direction control unit 136 applies a bias voltage corresponding to the predetermined radiation direction to each of lumped elements 128-1, 128-2, through to 128-6 in order to adjust the reactance of each of the lumped elements 128-1, 128-2, through to 128-6 corresponding to the determined direction.

When the parallel radiation direction control unit 134 and the perpendicular radiation direction control unit 136 perform such operations, the antenna 110 has the predetermined radiation direction.

Figure 2:
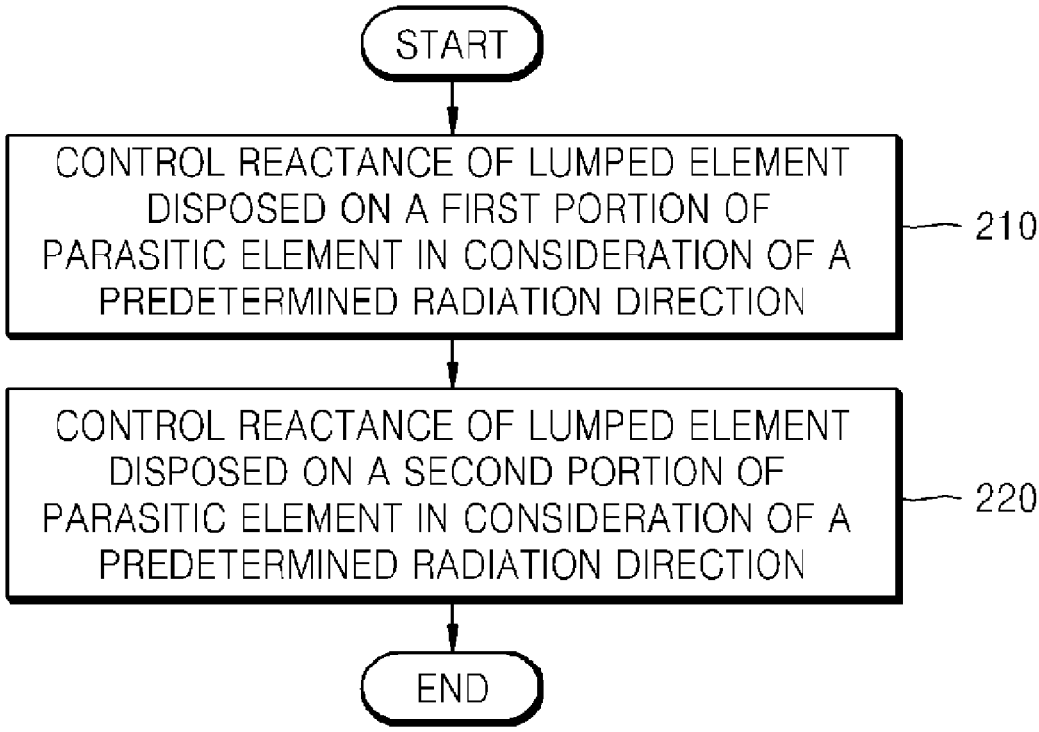
FIG. 2 is a flow chart illustrating a method of controlling the radiation direction of an antenna according to an embodiment of the present invention.

FIG. 2 is a flow chart illustrating a method of controlling the radiation direction of an antenna according to an embodiment of the present invention. The method includes operations 210-220 to control the radiation direction of an antenna to be oriented in various directions.

A determination unit controls the reactance of a lumped element **126-*n* disposed on a first portion of each of parasitic elements 120-1, 120-2, through to 120-6 which is inclined with respect to a ground surface 112 at a first angle, for example, a portion 122-*n* perpendicular to the ground surface 112, in consideration of a predetermined radiation direction of the antenna 110 (operation 210**.)

Also, the determination unit controls the reactance of a lumped element **128-*n* disposed on a second portion of each of parasitic elements 120-1, 120-2, through to 120-6, which is inclined with respect to the first portion by a second angle, for example, a portion 124-*n* parallel to the ground surface 112, in consideration of a predetermined radiation direction of the antenna 110 (operation 220**.)

Operation 220 can be performed as illustrated in FIG. 2, that is, Operation 220 can be performed after Operation 210. Alternatively, unlike the flow chart illustrated in FIG. 2, Operation 210 and Operation 220 can be performed at the same time, or Operation 220 can be performed before Operation 210.

When Operations 210 and 220 are completed, the antenna 110 has the predetermined radiation direction.

A program for performing in a computer the method of controlling the radiation direction according to the present invention described above, can be stored in a computer-readable recording medium. The computer-readable recording medium may be magnetic storage medium, such as ROMs, floppy disks, and hard disks; or optically-readable medium, such as CD-ROMs or digital versatile discs (DVDs.)

While the present invention has been particularly shown and described with reference to exemplary embodiments thereof, it will be understood by those of ordinary skill in the art that various changes in form and details may be made therein without departing from the spirit and scope of the present invention as defined by the following claims.

The invention claimed is:

1. An apparatus for controlling a radiation direction of an antenna, the apparatus comprising:

an antenna;

a plurality of parasitic elements disposed in a concentric array around the antenna, wherein each parasitic element comprises a first portion disposed parallel to a ground surface and a second portion that is inclined with respect to the first portion at a first angle, each of the first portions comprising a first lumped element, and each of the second portions comprising a second lumped element; and a determination unit comprising a central control unit, a first radiation direction control unit configured to control the reactance of each of the first lumped elements, and a second radiation direction control unit configured to control the reactance of each of the second lumped elements to control the radiation direction of the antenna, wherein the first radiation direction control unit is configured to vary the reactance of each of the first lumped elements to establish a component of the radiation direction that is in a plane perpendicular to each first portion, and wherein the second radiation direction control unit is configured to vary the reactance of each of the second lumped elements to establish a component of the radiation direction that is in a plane perpendicular to each second portion.

2. The apparatus of claim 1, wherein each of the second portions are perpendicular to the ground surface.

3. The apparatus of claim 1, wherein each of the parasitic elements is L shaped.

4. The apparatus of claim 1, wherein the parasitic elements are spaced apart by a predetermined distance from the antenna.

5. The apparatus of claim 1, wherein the antenna is a monopole antenna connected to the ground surface.

6. A method of controlling a radiation direction of an antenna in proximity to parasitic elements, each of which comprises a lumped element having a variable reactance, the method comprising:

providing first portions of the parasitic elements disposed parallel to a ground surface, each of the first portions comprising a first lumped element having a variable reactance;

providing second portions of the parasitic elements disposed at a first angle to the first portions, each of the second portions comprising a second lumped element having a variable reactance;

controlling a reactance of each first lumped element in consideration of a component of a predetermined radiation direction that is in a plane perpendicular to each first portion; and controlling a reactance of each second lumped in consideration of a component of the predetermined radiation direction that is in a plane perpendicular to each second portion, wherein the parasitic elements are disposed in a concentric array around the antenna, the controlling the reactance of each first lumped element is performed by a first controller, and the controlling the reactance of each second lumped element is performed by a second controller.

7. The method of claim 6, wherein the second portions are perpendicular to the ground surface.

8. The method of claim 6, wherein each of the parasitic elements is L shaped.

9. The method of claim 6, wherein the number of the lumped elements disposed on each of the parasitic elements is two or more.

10. The method of claim 6, wherein the parasitic elements are spaced apart by a predetermined distance from the antenna.

11. The method of claim 6, wherein the antenna is a monopole antenna connected to the ground surface.

* * * * *